United States Patent [19]

Murai et al.

[11] Patent Number: 4,639,117

[45] **Date of Patent: * Jan. 27, 1987**

[54] RECORDING IMAGE DENSITY CONTROL METHOD FOR ELECTROPHOTOGRAPHY

[75] Inventors: Kazuo Murai, Tokyo; Yasushi Koichi, Yamato, both of Japan

[73] Assignee: Ricoh Company, Ltd., Tokyo, Japan

[ * ] Notice: The portion of the term of this patent subsequent to Feb. 25, 2003 has been disclaimed.

[21] Appl. No.: 439,211

[22] Filed: Nov. 4, 1982

[30] Foreign Application Priority Data

Nov. 7, 1981 [JP] Japan ..... 56-178891

[51] Int. Cl.[4] ..... G03G 15/00

[52] U.S. Cl. ..... 355/14 R; 355/14 D; 355/14 C; 430/30

[58] Field of Search ..... 355/14 D, 14 E, 14 CH, 355/14 R, 14 C; 118/664, 665, 688–691; 430/30

[56] References Cited

U.S. PATENT DOCUMENTS

| | | | |
|---|---|---|---|
| 3,922,380 | 11/1975 | Rowell et al. | 355/14 D X |
| 4,026,643 | 5/1977 | Bergman | 355/14 D X |
| 4,277,162 | 7/1981 | Kasahara et al. | 355/14 D X |
| 4,326,646 | 4/1982 | Lavery et al. | 355/14 C X |
| 4,341,461 | 7/1982 | Fantozzi | 355/14 D |
| 4,372,672 | 2/1983 | Pries | 355/14 D X |

*Primary Examiner*—Arthur T. Grimley
*Assistant Examiner*—J. Pendegrass
*Attorney, Agent, or Firm*—Oblon, Fisher, Spivak, McClelland, & Maier

[57] ABSTRACT

A recording image density control method for electrophotography comprising the steps of forming at least two latent electrostatic image patterns with different electric potentials on the surface of a photoconductor; developing the latent electrostatic images patterns to toner image patterns by use of toner contained in the developer; detecting data relevant to image density for each developed toner image pattern (such as the image density of each developed toner image pattern, for instance, by a toner image pattern, for instance, by a photosensor), with a different resolution for each image pattern; determining the ratio of the data for one image pattern to the data for the other image pattern by A/D conversion; and controlling at least one recording image density controlling parameter, such as the amount of the toner supplied to a development apparatus, in accordance with the ratio for controlling recording image density, whereby recording image density can be controlled.

5 Claims, 11 Drawing Figures

RECORDING IMAGE DENSITY CONTROL METHOD FOR ELECTROPHOTOGRAPHY

BACKGROUND OF THE INVENTION

The present invention relates to an image density control method for electrophotography, and more particularly to an image density control method of the type in which at least two latent-electrostatic-image test patterns which are significantly different from each other in the electric potential of the latent electrostatic images are formed on the surface of a photoconductor, and values relevant to the image density of each test pattern when developed are detected and, in accordance with the detected values, copy processing parameters which have an effect on the image density are controlled.

In conventional electrophotographic copying apparatus and electrostatic recording apparatus, latent electrostatic images formed on a latent-electrostatic-image-bearing member are developed by colored fine particles called toner, which toner is supplied from a development apparatus. The toner is electrically charged to a polarity opposite to the polarity of the latent electrostatic images, so that the toner particles are electrostatically attracted to the latent electrostatic images, whereby the above mentioned development is performed.

As a method of electrically charging toner to a polarity opposite to the polarity of latent electrostatic images, a method is known of mixing toner particles and carrier particles (which together constitute a developer), so that the toner particles and carrier particles are triboelectrically charged. Such a developer is generally called a two-component type developer. In a development method in which a two-component type developer is employed, the toner particles can be electrically charged easily and sufficiently for development. However, during the development process, only the toner particles are consumed, and variation in the relative concentrations of toner and carrier effect the image density. Therefore, a means for maintaining constant concentration of the toner in the developer is required, and, to do this, accurate measurement of the concentration of toner is indispensable.

A method of measuring the toner concentration of a developer is proposed in Japanese Patent Publication SHO 43-16199/1968. In that method, a standard latent electrostatic image pattern is formed on a photoconductor and the latent electrostatic image pattern is developed to a visible image pattern. The image density of the thus developed image pattern is photoelectrically measured, whereby the toner concentration of a developer is indirectly measured.

In addition to the above described indirect toner concentration measurement method, there are conventionally known a number of direct methods, for instance, a method of measuring the weight of a unit volume of the developer, and a method of measuring the permeability of the developer.

Furthermore, as a method for controlling image density relating to the toner concentration of a developer, the following methods have been proposed:

(1) A method of controlling a development bias voltage in accordance with the difference between the reflectance of a standard density plate and the reflectance of an original (Japanese Laid-Open Patent Application 53-103736/1978);

(2) A method of controlling development characteristics by detecting the image density during the process of copying a standard original (Japanese Laid-Open Patent Application SHO 54-141645/1979); and (3) A method of controlling the charging of a photoconductor, development bias voltage and exposure by detecting the image density of an original, the potential of a latent electrostatic image, and the image density of developed image (U.S. Pat. No. 2,956,487).

Of the above mentioned recording image density control methods, in the case where an image is projected upon the surface of a photoconductor to form the corresponding latent electrostatic image thereon, and the latent electrostatic images are developed to visible image patterns, and the image density of each image pattern is detected by a photosensor, if toner particles are deposited on a light emission element and a light receiving element which constitute the photosensor, or if those elements have deteriorated, the input and output characteristics of the photosensor vary and correct control of the toner concentration cannot be attained.

In U.S. Pat. No. 4,082,445, there is disclosed a method of measuring image density, while correcting for changes in characteristics of a light receiving element and a photoconductor, if any, which are caused, for instance, by changes in power source voltage, toner deposition on the light receiving element, changes in ambient temperature, and deterioration of the light receiving element and photoconductor with time. In this method, the reflectance of a non-image area in a photoconductor, where no toner is deposited, is measured photoelectrically. Since the uncovered surface of a photoconductor should have its own constant reflectance, periodic reflectance measurement of the non-image area (or background) will indicate changes in characteristics of the photoconductor, if any. If the characteristics change, the electric current which flows through the light emission element is changed until the light receiving element outputs a normal voltage output. Thus, with the image density and output voltage characteristics of the light receiving element corrected, the image density of a standard image is measured, whereby the concentration of toner is controlled. In this method, however, it is necessary to cause relatively great electric current to flow through the light emission element. Therefore, a special circuit is necessary for that, which makes the apparatus using this method expensive. Furthermore, the life of the light emission element will be short due to the flowing of relatively great electric current therethrough.

SUMMARY OF THE INVENTION

It is therefore an object of the present invention to provide a recording image density control method for electrophotography capable of performing reliable control of recording image density with minimum affect from changes either in the operational characteristics of a photosensor for obtaining data relevant to image density, or in a photoconductor for forming latent electrostatic images thereon.

Another object of the present invention is to provide a recording image density control method of the type described above in which two test patterns are made on the photoconductor for controlling recording image density, and data from those two test patterns for controlling recording image density are detected with different resolutions, whereby toner concentration control errors which may be caused by the difference in the data detection levels or ranges between the two test patterns can be obviated.

A further object of the present invention is to provide a recording image density control method of the type described above in which the control operation necessary for the control of recording image density is simplified as compared with conventional control operations.

In the present invention, in order to attain the above-described objects, data relevant to control of image density of each test pattern are subjected to analog-digital conversion with a different resolution, and the thus obtained digital data of each test pattern are compared. By that comparison, parameters for controlling the image density are controlled. According to the present invention, since the data relevant to the image density of each pattern are compared by digital data with each resolution for each pattern, with appropriate weight applied to the data of each pattern, the data for controlling image density can be obtained accurately by appropriate choice of each resolution, without reducing the measurement accuracy by multiplication or division in the course of data processing, so that the data relevant to the image density accurately reflect the parameters for controlling image density.

As to the changes in the data relevant to image data caused by changes in characteristics of a photosensor and of a photoconductor employed in the present invention, since they appear in each pattern with a parallel relationship, that parallel relationship is also employed for more accurate control of recording image density according to the present invention, whereby the above described objects of the present invention are attained.

BRIEF DESCRIPTION OF THE DRAWINGS

In the drawings,

FIG. 5*a*-1 and FIG. 5*a*-2 show a flow chart showing the interruption processing of a microprocessor MPU2.

FIG. 5*b*-1 and FIG. 5*b*-2 show a main flow chart of a recording image density control method according to the present invention.

DETAILED DESCRIPTION OF THE PREFERRED EMBODIMENTS

Figure 1:
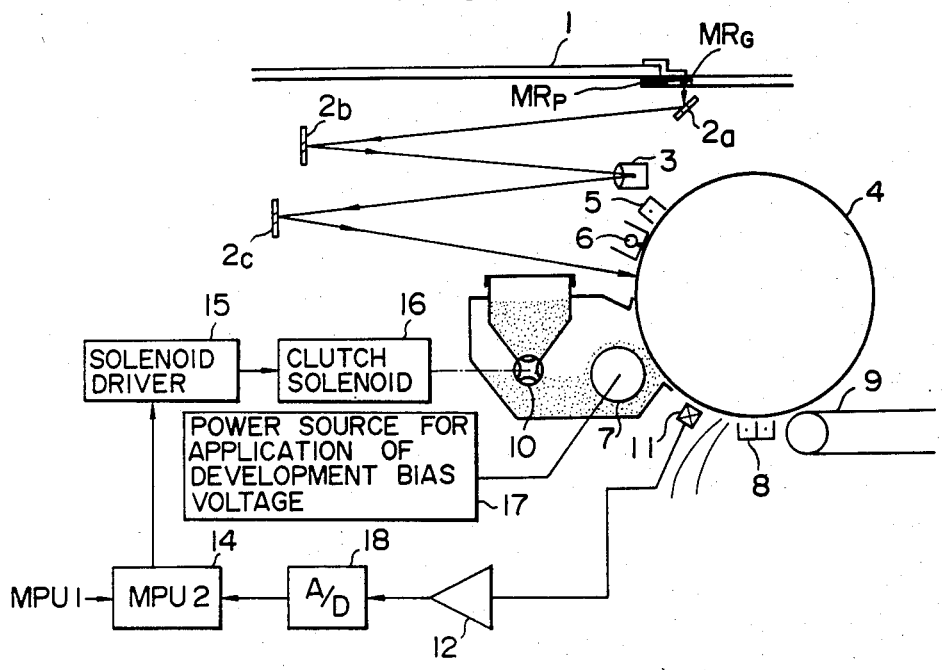
FIG. 1 is a schematic diagram of a copying machine in which an embodiment of a recording image density control method for electrophotography according to the present invention is employed, particularly in explanation of the control of toner concentration.

Referring to FIG. 1, there is shown a schematic diagram of a copying machine in which an embodiment of a recording image density control method for electrophotography according to the present invention is employed, particularly in explanation of the control of toner concentration in the present invention.

In the figure, the images of an original (not shown) placed on a contact glass 1 are projected upon the surface of a photoconductor drum 4 through a first mirror 2*a*, a second mirror 2*b*, an in-mirror lens 3 and a third mirror 2*c*. The first mirror 2*a* and the second mirror 2*b* are driven in scanning to the left with a predetermined speed ratio, in synchronization with the counterclockwise rotation of the photoconductor drum 4. The latent electrostatic images of the original are formed on the surface of the photoconductor drum 4 and are then developed to visible images by a developer supplied by a development roller 7 in a development apparatus. The thus developed images are transferred from the surface of the photoconductor drum 4 to a recording sheet by an image transfer charger 8. The recording sheet is then transported to an image fixing apparatus (not shown) by a separation belt 9.

For use in the present invention, a while pattern $MR_G$ and a black pattern $MR_P$ on the left side of the white pattern $MR_G$ are formed within an image projection field at the home position of the first mirror 2*a*. When the first mirror 2*a* is moved to the left for exposure scanning, the latent electrostatic images of the white pattern $MR_G$ and the black pattern $MR_P$ are formed side by side on the surface of the photoconductor drum 4. As shown in FIG. 1, there is disposed a photosensor 11 for measuring the image density of the developed toner image on the surface of the photoconductor drum 4. Hereinafter, the developed image formed on the surface of the photoconductor drum is referred to as the toner image. The detection signal output from the photosensor 11 is amplified by an amplifier 12, subjected to waveform shaping and then to analog-digital conversion (hereinafter referred to as the A/D conversion) by an A/D converter 18, and input to a microprocessor 14 (MPU2). The microprocessor 14 operates the ratio of the image density of the developed toner image pattern corresponding to the white pattern $MR_G$ to the image density of the developed toner image pattern corresponding to the black pattern $MR_P$, determines the amount of the toner to be supplied in accordance with the obtained image density ratio and gives a command to a solenoid driver 15 so as to continuously energize a clutch solenoid 16 for a period of time corresponding to the amount of the toner to be supplied. In accordance with that command, the clutch solenoid 16 is continuously energized for the above mentioned period of time. Upon the clutch solenoid 16 being energized, a toner supply roller 10 is connected to a drive system (not shown) of the photoconductor drum 4 and is driven in rotation, so that the toner is supplied from a toner tank to the development apparatus.

In FIG. 1, reference numeral 5 indicates a main charger for charging uniformly the surface of the photoconductor drum 4, and reference numeral 6 indicates an eraser lamp for quenching electric charges in the areas outside a recording sheet area on the surface of the photoconductor drum 4. In this embodiment, toner is supplied in an amount in accordance with the value obtained for the toner image density ratio determined by the microprocessor 14. Another microprocessor MPU1 performs other controls for the copying operation. The amount of the toner to be supplied is predetermined in accordance with the size of each recording sheet, and, by the MPU1, a predetermined amount of the toner is supplied for each copying, corresponding to the size of the recording sheet employed. In other words, when necessary, by the microprocessor 14, the toner is supplied in an amount compensating for the amount of the toner supplied by the MPU1.

Figure 2:
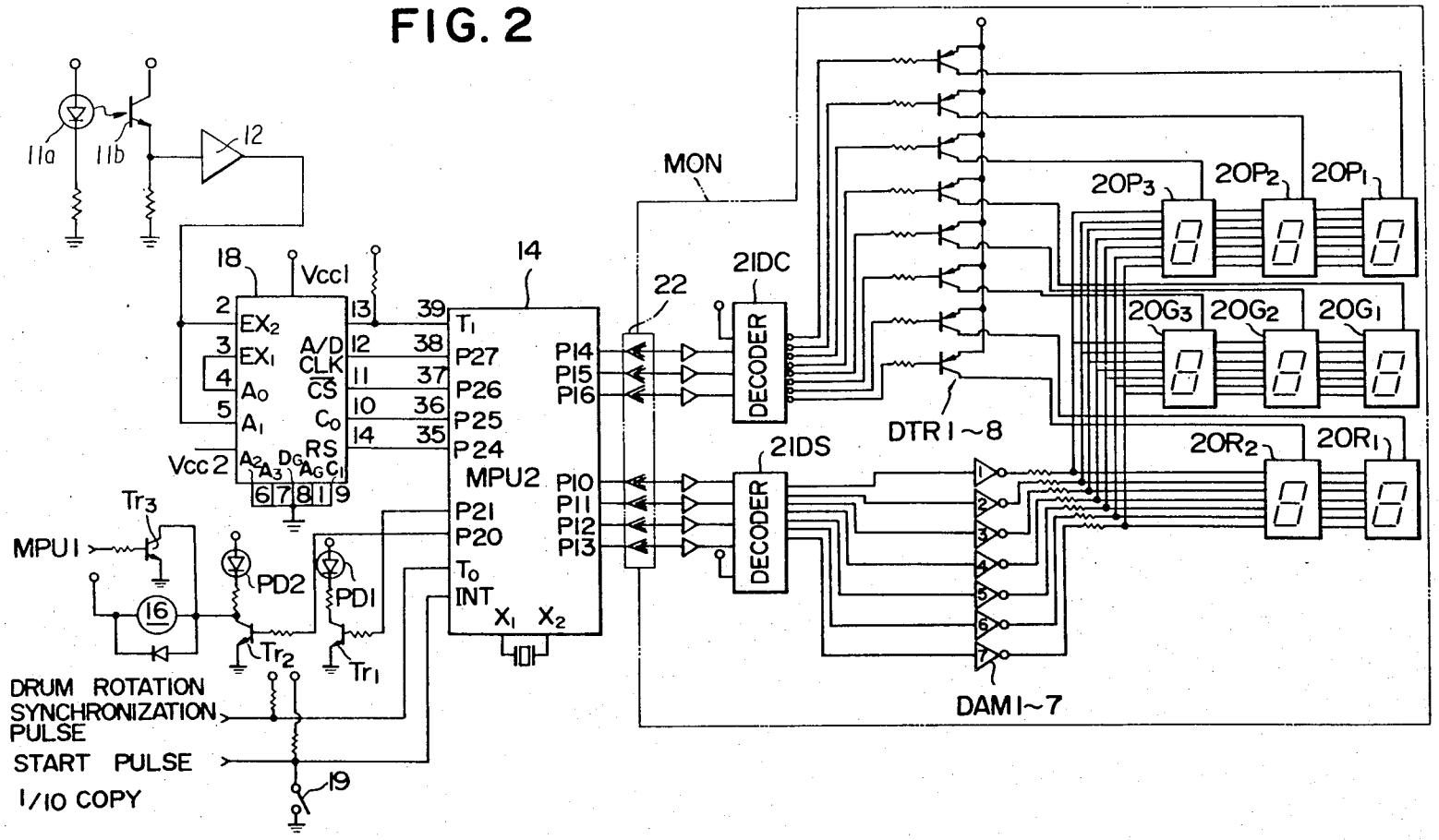
FIG. 2 is a diagram of electric circuits particularly indicating the connection of a microprocessor 14 with an A/D converter 18 shown in FIG. 1.

Referring to FIG. 2, there is shown a detailed diagram of the electric circuits of the microprocessor 14 shown in FIG. 1. In the figure, reference numeral 11*a* indicates a light emission diode, and reference numeral 11*b* indicates a phototransistor. The light emission diode 11*a* and the phototransistor 11*b* constitute a photosensor 11. Light from the light emission diode 11*a* is projected upon the surface of the photoconductor drum 4, and the light reflected by the photoconductor drum 4 is detected by the phototransistor 11*b*. The emitter voltage of the phototransistor 11*b* is applied directly (without any division) to an input channel $A_1$ of an A/D comparator 18 (Model MB4052 made by Fujitsu, Ltd.), and to an input channel A0 through voltage dividing terminals $EX_2$ and $EX_1$. A digital data (serial) output terminal DATA OUT of the A/D comparator 18 is connected to an interruption terminal $T_1$ of the microprocessor 14, while control input terminals (A/D CLK, CS, Co and RS) are respectively connected to output ports P24 through P27 of the microprocessor 14.

Figure 3:
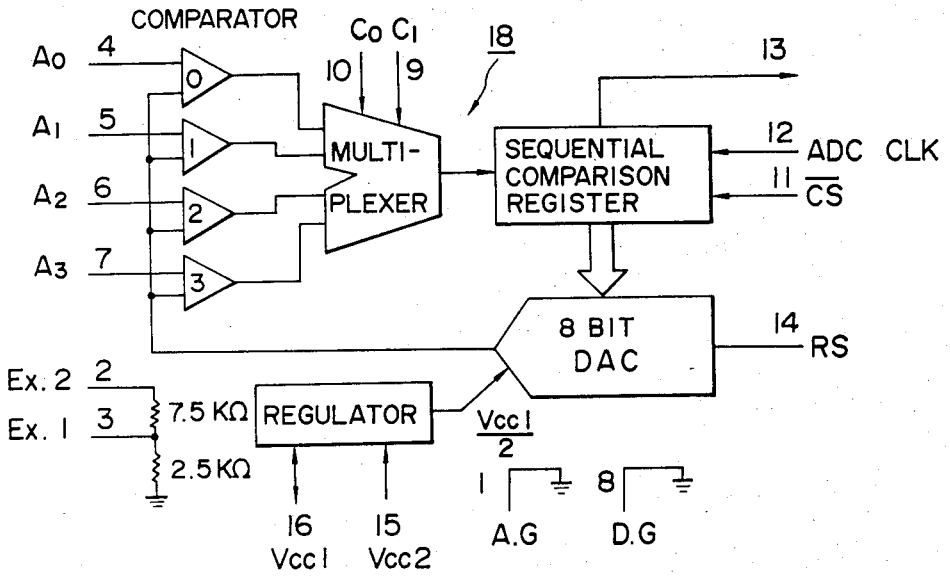
FIG. 3 is a block diagram showing the structure of the A/D converter 18 shown in FIG. 1.

Referring to FIG. 3, there is shown a block diagram showing the internal structure of the A/D converter 18. The A/D converter 18 is an 8 bit A/D converter capable of performing range selection of the input voltage ranges of Vcc/2 and Vcc/8, with a four-times range expansion.

Preliminary experiments on the A/D converter indicated as follows:

(1) Toner image density detection level (background level) $V_{SG}$ on the surface of the photoconductor corresponding to the white pattern $MR_G$ was 4.0 V.

(2) Toner image density detection level (black level) $V_{SP}$ on the surface of the photoconductor corresponding to the black pattern $MR_P$ was 1.6 V.

For the above, the maximum voltage of the input channels A0 through $A_3$ was 2.5 V.

From the above data, by use of the range expansion, the measurement level $V_{cc}/2\times4\rightarrow0$ V to 10 V is employed for the background level $V_{SG}$, while the $V_{cc}/2\rightarrow0$ V to 2.5 V is employed for the black level $V_{SP}$.

The emitter of the phototransistor 11*b* is connected (without any division) to the voltage dividing terminal $EX_2$ of the A/D converter 18, and the voltage dividing terminal $EX_1$ is connected to the input channel A0. Therefore, in the case of the A/D conversion designating the input channel as A0, a four-times range expansion is performed since $2.5/(7.5+2.5)=\frac{1}{4}$. The input channel A0 is used for detection of the background level $V_{SG}$, while the input channel A1 is used for detection of the black level $V_{SP}$ since the emitter of the phototransistor 11*b* is directly connected (without any division) to the input channel A1. In this case, the value obtained by multiplying the A/D conversion data of $V_{SG}$ by 4 and the A/D conversion data of $V_{SP}$ are in the same range. In other words, the relationship between the digital output n and the input voltage satisfies the following equations:

Background Level $V_{SG}(n)=62+(n-1)\times39.126$ mV

Black Level $V_{SP}(n)=17+(n-1)\times9.7756$ mV

For example, when n=103 in the background level $V_{SG}(n)$, $V_{SG}(\text{analog})=62+102\times39.126\ mV=3.991$ V, while when n=163 in the black level $V_{SP}(n)$, $V_{SP}(\text{analog})=17+162\times9.7756\ \text{mV}=1.6006$ V.

Referring back to FIG. 2, to an output port P20 of the microprocessor 14, there is connected the base of a switching transistor $T_{r2}$ which constitutes the solenoid driver 15 shown in FIG. 1. The clutch solenoid 16 is connected to the transistor $T_{r2}$. When a high level signal [1] (H) is set at the output port P20, the transistor $T_{r2}$ becomes electrically conductive, so that electric current flows through the solenoid 16, whereby the developer feed roller 10 (shown in FIG. 1) is connected to a drive system (not shown) and is driven in rotation.

For the purpose of supplying toner in a predetermined amount corresponding to each size of copy sheet for each copying, a transistor $T_{r3}$ is connected to the solenoid 16. When the transistor $T_{r3}$ is turned on, the toner is also supplied. The ON and OFF of the transistor $T_{r3}$ are controlled by the copy controlling microprocessor MPU1. When at least one of the transistors $T_{r2}$ and $T_{r3}$ is turned on, that is, when the toner is supplied, the light emission diode PD2 for indicating toner supply, which is connected to one terminal of the solenoid 16, is lighted. The base of the transistor $T_{r1}$ is connected to an output port P21 of the microprocessor 14, and a light emission diode PD1 for monitoring is connected to the transistor $T_{r1}$. The microprocessor 14 turns on the transistor $T_{r1}$ when the A/D conversion is initiated, so that the light emission diode PD1 is lighted, while when a predetermined amount of the toner has been supplied, the microprocessor 14 turns off the transistor $T_{r1}$, so that the light emission diode PD1 is turned off.

To an interruption terminal INT of the microprocessor, for example, 14, there is applied one pulse for, for example, every 10 copies when the copying machine is in operation, as a toner concentration control indication signal, by the microprocessor MPU1 for copy control. Furthermore, to an interruption terminal To, there is applied a drum rotation synchronization pulse which is generated for a predetermined rotation angle of the photoconductor drum 4. As will be described later in more detail, the microprocessor 14 counts the above mentioned drum rotation synchronization pulses, thereby controlling the amount of the toner to be supplied. Output ports P14 through P16, and P10 through P13 of the microprocessor 14 are connected to a connector 22. To the connector 22 is connected a monitor unit MON when the copying machine is checked for maintenance.

The monitor unit MON is provided with character displays 20G1 through 20G3 for displaying the white level $V_{SG}$, character displays 20P1 through 20P3 for displaying the black level $V_{SP}$, character displays $20R_1$ and $20R_2$ for displaying the image density ratio $V_{SG}/V_{SP}$, a segment decoder 21DS, a digit decoder 21DC, segment drivers DAM1 through DAM7, and digit drivers DTR1 through DTR8.

When the monitor unit MON is connected to the control 22, $V_{SG}$, $V_{SP}$ and $V_{SG}/V_{SP}$ are displayed.

In FIG. 2, the switch 19 is for commanding the control of toner concentration. When the switch 19 is closed, toner concentration control is initiated. At the time of inspection for maintenance, the switch 19 is closed.

Figure 4:
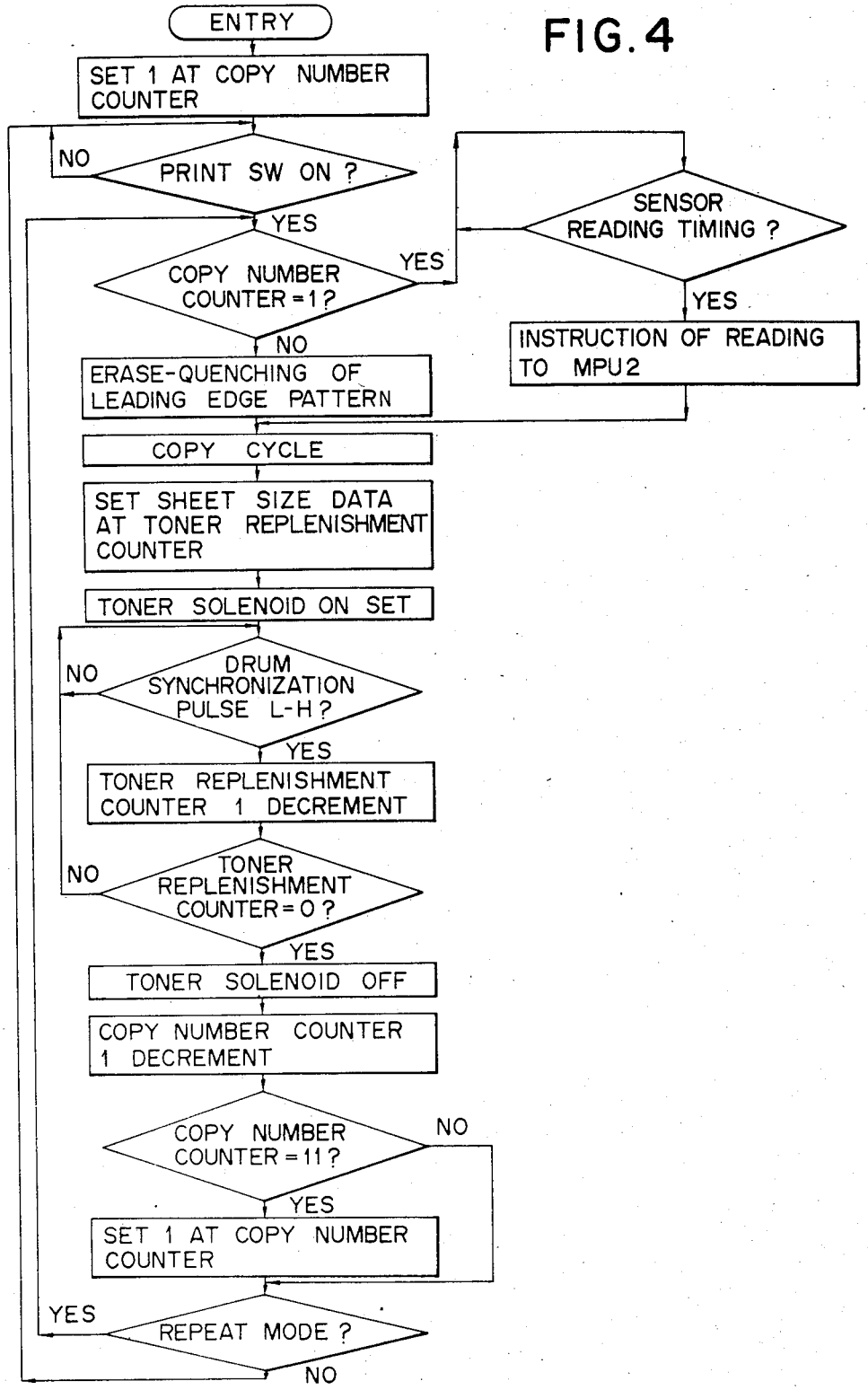
FIG. 4 is a flow chart showing the command timings of the toner supply control and toner concentration control of a micro MPU1 for copy control.

Referring to FIG. 4, there is shown a partial flow chart showing an outline of the toner supply control, in particular, a predetermined amount of toner supplied in accordance with the size of each recording sheet by the microprocessor MPU1. When the copying machine is ready for the copying operation, the microprocessor MPU1 sets 1 at a copy number counter (program counter) for setting the timing for commanding toner concentration control and waits for the closing of a print switch SW by which the copying command is given. When the print switch SW is closed, the charger 5 is energized and exposure is then initiated. At the same time, the counting of the drum rotation synchronization pulses is also initiated. When the white pattern $MR_G$ projected upon the photoconductor drum 4 through the first mirror 2*a* comes under the photosensor 11, a toner concentration control command signal (start pulse) is input to the interruption terminal INT of the microprocessor 14 (MPU2). When the contents of the copy number counter are 2 to 10 (per this example), the eraser lamp 6 is energized, without application of the start pulse, and charge quenching is performed as far as the black pattern $MR_P$, so that copying control is continued. When the first copying has been finished, the copy size data (including the toner application period of time corresponding to each recording sheet size; the number of the drum rotation synchronization pulses) are set at a toner replenishment counter (program counter), and the transistor $T_{r3}$ (refer to FIG. 2) is turned on. Thereafter at the arrival of each drum rotation synchronization pulse, one decrement of the toner replenishment counter is performed, and when the contents of the toner replenishment counter become zero, the transistor $T_{r3}$ is turned off. One increment of the copy number counter is then done. In the case of continuous copy setting, that is, in the case of the so-called repeat mode, the copying operation is started again. In the case of single copy setting, the process returns to the previously mentioned print switch SW closure awaiting step at which the closing of the print switch SW is waited for. Each time the contents of the copy number counter amount to 11 (say), the contents of the copy number counter are reset at 1, and only when the contents of the copy number counter are 1 is a toner concentration control command given to the microprocessor 14 (MPU2). During the copying process, toner concentration control is performed one time per 10 (say) sheets of copy paper.

The toner concentration control by the microprocessor 14 (MPU2) will now be explained.

(1) Detection of the image densities of the developed toner images corresponding to the white pattern $MR_G$ and the black pattern $MR_P$ formed on the photoconductor drum 4, (2) comparison operation of the detection values obtained above to obtain the ratio, and (3) setting of the amount of the toner to be replenished in accordance with the ratio obtained by the comparison operation, are performed by the interruption control in response to the application of the toner concentration control command pulse (start pulse) from the microprocessor MPU1 to the interruption terminal INT. The replenishment control of the amount of the toner set by the above and the display energizing control of the displays 20G1 through 20G3, 20P1 through 20P3, 20R1 and 20R2 are performed in accordance with the main routine.

Figures 1, 5A:
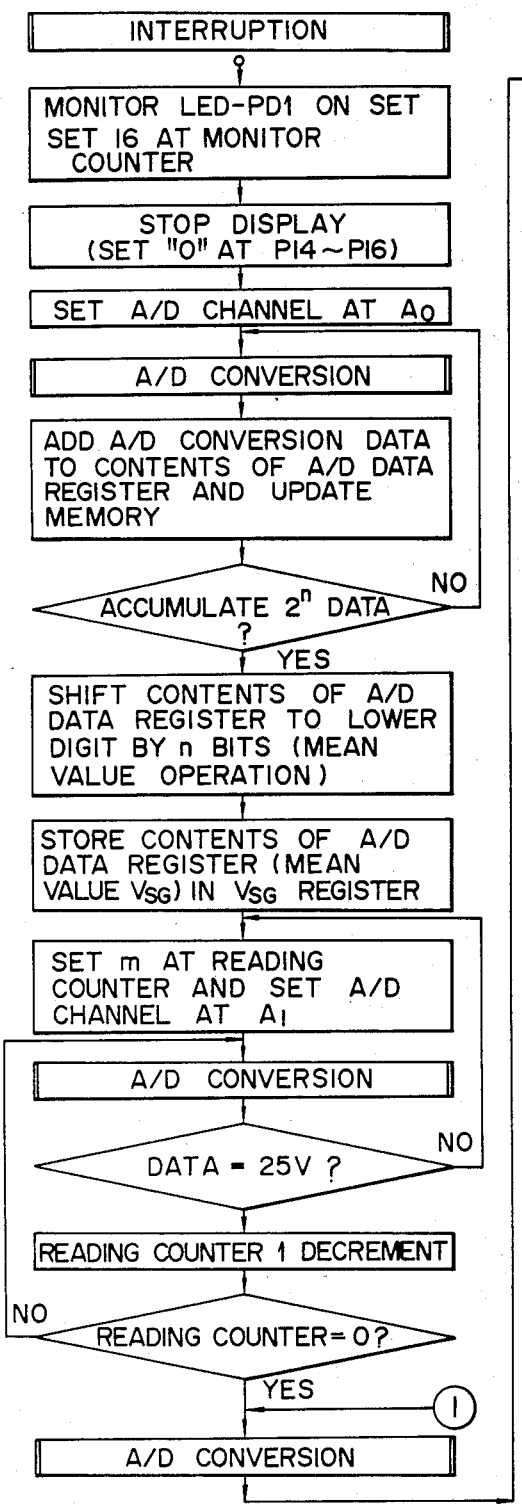
Figure 5A:
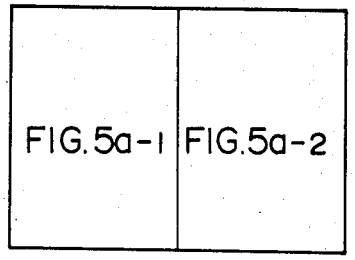
Figures 2, 5A:
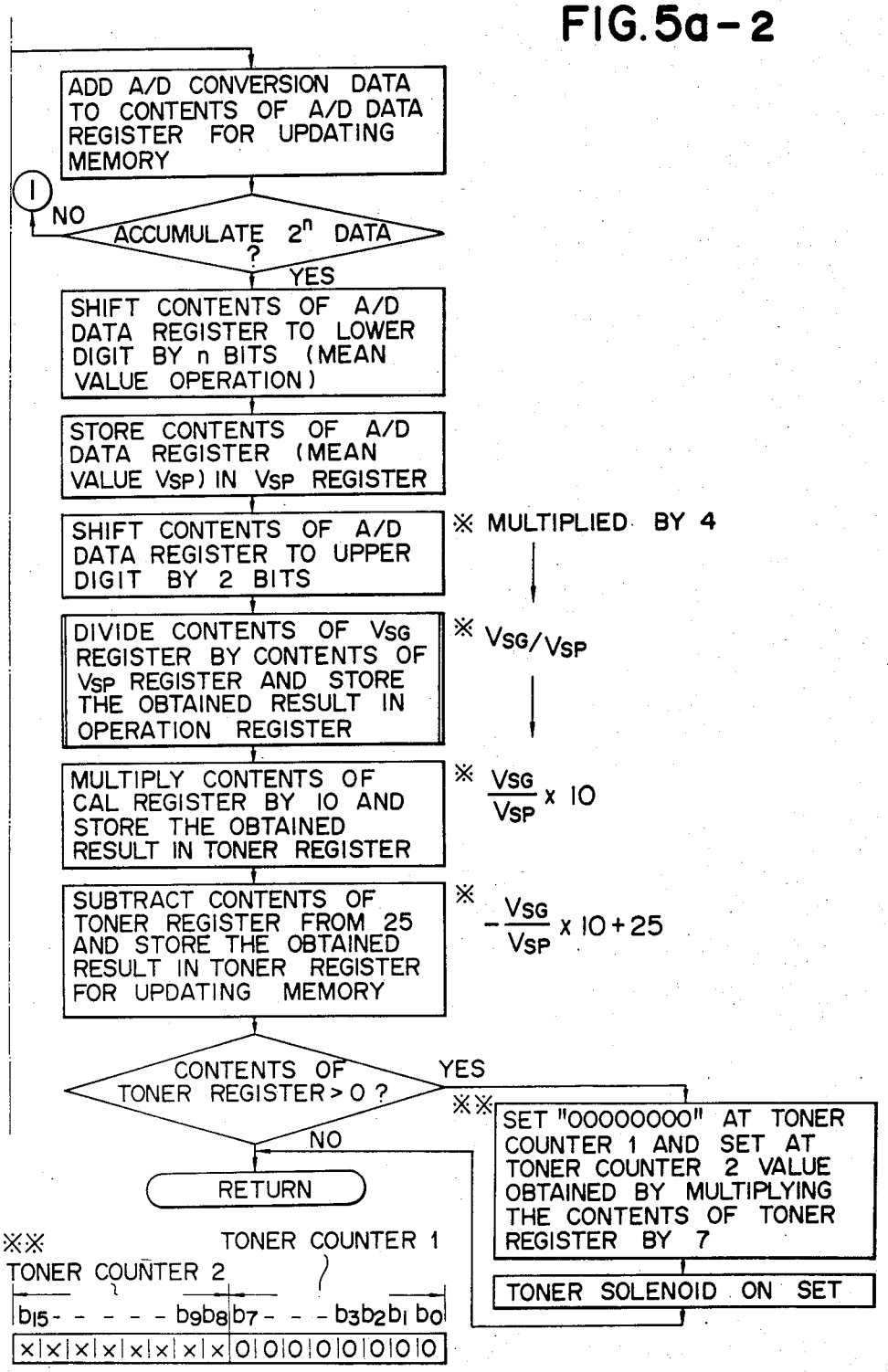

Referring to a flow chart shown in FIGS. 5*a*-1 and 5*a*-2, the interruption control will now be explained.

When the interruption input terminal INT changes from a high level [1] (H) to a low level [0] (L), the microprocessor 14 (hereinafter referred to as the MPU2) sets [1] at the input port P21, so that the diode PD1 is lighted and 16 is set at the monitor counter. Then [0] is set at the output ports P10 through P16, so that the displays 20G1 through 20G3, 20P1 through 20P3, 20R1 and 20R2 are turned off, and the input channel is set at Ao in the A/D comparator 18. A data conversion timing pulse (A/D CLK) is applied to the A/D converter 18, and the A/D conversion data (8 bits) are serially read at a port $T_1$, and the A/D conversion data are subjected to addition storage in the A/D data register. When the A/D conversion and addition of the A/D conversion data are repeated $2^n$ times, the contents of the A/D data register are shifted to lower digits by n bits. By this digital shift, the contents of the A/D data register indicate the mean value of the $2^n$ A/D conversion data.

As explained previously, the toner concentration control command pulse (start pulse) to be input to the interruption terminal INT is generated at such a timing that the developed toner image corresponding to the white pattern $MR_G$ has arrived under the photosensor 11 comprising the light emission diode 11*a* and the phototransistor 11*b*. Therefore, the A/D conversion data with designation of the input channel Ao indicate the toner image density $V_{SG}$ at the white level.

The MPU2 stores the mean value $\overline{V_{SG}}$ of the toner image density at the white level in the $V_{SG}$ register, and then sets a continuous count value m in the reading counter in order to detect the boundary between the toner image of the white pattern $MR_G$ and the toner image of the black pattern $MR_P$, and sets the input channel for the A/D conversion at A1, whereby the A/D conversion is performed likewise.

As mentioned previously, toner image density detection voltage is directly (without any division) applied to the input channel A1, and the maximum limitation for the input analog voltage is 2.5 V. Further, the toner image density detection voltage (analog) for the white pattern $MR_G$ is 2.5 V or more, while the toner image density detection voltage for the black pattern $MR_G$ is less than 2.5 V. Therefore, whether or not the input voltage of the input channel A1 is more than 2.5 V differentiates the white pattern from the black pattern. Since the full scale for the input voltage at the input channel A1 is 2.5 V, the digital data for more than 2.5 V is 2.5 V.

When the digital conversion data indicate the value of 2.5 V, the MPU2 performs the A/D conversion again and repeats the same on the supposition that the photosensor 11 is still detecting the white pattern $MR_G$. On the other hand, when the digital conversion data indicate the value of less than 2.5 V, the contents of the reading counter is updated by one decrement, so that the A/D conversion is performed. When the A/D conversion data indicate the value of less than 2.5 V continuously m times, and the contents of the reading counter become zero, the detection voltage at the input channel A1 of the A/D converter 18 is subjected to the A/D conversion $2^n$ times and is averaged in the A/D register, with the supposition that the toner image of the black pattern $MR_P$ is within the detectable range of the photosensor 11. If the A/D conversion data indicate the value of 2.5 V once during the (m−1) repetitions of the A/D conversion after the A/D conversion data have indicated a value of less than 2.5 V, m is set at the reading counter again and the A/D conversion is repeated until the A/D conversion data indicate a value of less than 2.5 continuously during the m repetitions of the A/D conversion. When the $2^n$ times conversion and the accumulation of the data have been completed, the MPU2 shifts the contents of the A/D data register to a lower digit by n bits, whereby the contents of the A/D data register indicate the mean value $\overline{V_{SP}}$ of the input voltage detection value. At this stage, the value $V_{SG}$ indicates $\frac{1}{4}$ of the mean value of n samplings of the white level (hereafter the mean value is referred to as the value $\overline{V_{SG}}$, while the value $\overline{V_{SP}}$ indicates the mean value of the n samplings of the black level. The MPU2 shifts the contents of the $V_{SG}$ register to an upper digit by 2 bits, corrects the contents by expanding the contents, changes the contents of the $V_{SG}$ register to the contents on the basis of the scale of the $V_{SP}$, divides the contents of the $V_{SG}$ register by the contents of the $V_{SP}$ register, calculates the ratio of $\overline{V_{SG}}/\overline{V_{SP}}$ and stores that ratio in the operation register.

The MPU2 multiplies the contents of the operation (CAL) register by 10, stores the multiplied result in the toner register, and then stores in the toner register the remainder obtained by subtracting the contents of the toner register from 25 for updating. As a result, the content of the toner register is $(\overline{V_{SG}}/\overline{V_{SP}})\times 10-25$.

The meaning of the above formula is as follows:

The results obtained by the preliminary experiments indicated that when the reciprocal of $\overline{V_{SG}}/\overline{V_{SP}}$, that is, $\overline{V_{SP}}/\overline{V_{SG}}$, was less than 40%, replenishment of toner was unnecessary, but when $\overline{V_{SP}}/\overline{V_{SG}}$ exceeded 40%, replenishment of toner was necessary in an amount of 1 g per increase of 1.7% percentage points.

More specific data are given in the following table:

| $V_{SP}/V_{SG}$ (%) | Replenishment Amount of Toner (g) | $V_{SG}/V_{SP}\times 10$ |
|---|---|---|
| 40 | | 25 |
| 41.7 | 1 | 23.98 |
| 43.4 | 2 | 23.04 |
| 45.1 | 3 | 22.17 |
| 46.8 | 4 | 21.37 |
| 48.5 | 5 | 20.62 |
| 50.2 | 6 | 19.92 |
| 51.9 | 7 | 19.27 |
| 53.6 | 8 | 18.66 |

When the toner replenishment is done by the combination of the predetermined constant replenishment and the replenishment in accordance with the output of the photosensor 11, the variation of the output of the photosensor 11 becomes small, and when the amount of the toner is extremely insufficient, there is no problem if the toner is supplied in an amount more than the amount supplied by the parallel replenishment in accordance with the output of the photosensor 11. For these reasons, the amount of toner to be replenished is set as follows:

| | |
|---|---|
| $25-(V_{SG}/V_{SP}\times 10)\leqq 0$ | No toner replenishment |
| $25-(V_{SG}/V_{SP}\times 10)>0$ | Toner replenishment in an amount of n (integer) g by omitting fractions |

In practice, the replenishment of toner by the development apparatus was as follows:

1 g=13.04 sec=1794 PLS (the number of the drum rotation synchronization pulses)

By calculation, the following approximation can be obtained:

$$7\times 256\ \text{PLS}=1792\ \text{PLS}=0.999\ \text{g}$$

From the above, the replenishment amount X(g) of toner is given by the following equation:

$$X=(25-(\overline{V_{SG}}/\overline{V_{SP}}\times 10))\times 0.999$$

$$\approx 25-(\overline{V_{SG}}/\overline{V_{SP}}\times 10)$$

Therefore, the contents of the toner register indicate the amount of toner to be replenished. Replenishment of about 1 g of toner corresponds to a period of time required for counting 1792 drum rotation synchronization pulses. The time during which the solenoid 16 is continuously energized is $X\times 1792=X\times 7\times 2^8$. Therefore, the MPU2 stores $X\times 7\times 2^8$ in a toner counter 1 (register) for storing therein lower 8 bits, and in a toner counter 2 (register) for storing therein upper 8 bits. This can be accomplished by storing all 0 (zero) bits in the lower 8-bit-toner counter 1, and the binary data indicating the $X\times 7$ in the upper 8-bit-toner counter 2. When the toner supply time (corresponding to the counted number of the drum rotation synchronization pulses) is stored in the toner counter 1 and in the toner counter 2, the MPU2 sets [1] at the output port P20, whereby the solenoid 16 is energized, returning to the main routine (refer to FIGS. **5*b*-1 and 5*b*-2**).

Referring to FIGS. **5*b*-1 and 5*b*-2**, the main routine of the MPU2 will now be explained.

In the main routine, when the level of the drum synchronization pulse (port To) is at L, the MPU2 performs display energization control by which the displays 20P1 through 20P3, 20G1 through 20G3, 20R1 and 20R2 are energized for light emission in a sequential time divisional mode. When the level of the drum synchronization pulse changes from L to H, the MPU2 performs one increment of the key counter, energizing the 1 display (for 1st digit), and repeats the same, referring to the port To, so long as the level is H. When the above operation is repeated $\alpha$ times, a key end flag 1 for indicating the arrival of the synchronization pulse is set, on the supposition that the port To is continuously at the H level during that period and that the drum rotation synchronization pulse H has arrived. When there is a flag (monitor LED-PD1 ON flag) which indicates the lighting of the light emission diode PD1 for the monitor display, the monitor counter is subjected to one decrement. When the contents of the monitor counter become zero, the light emission diode PD1 is turned off.

Figures 1, 5B:
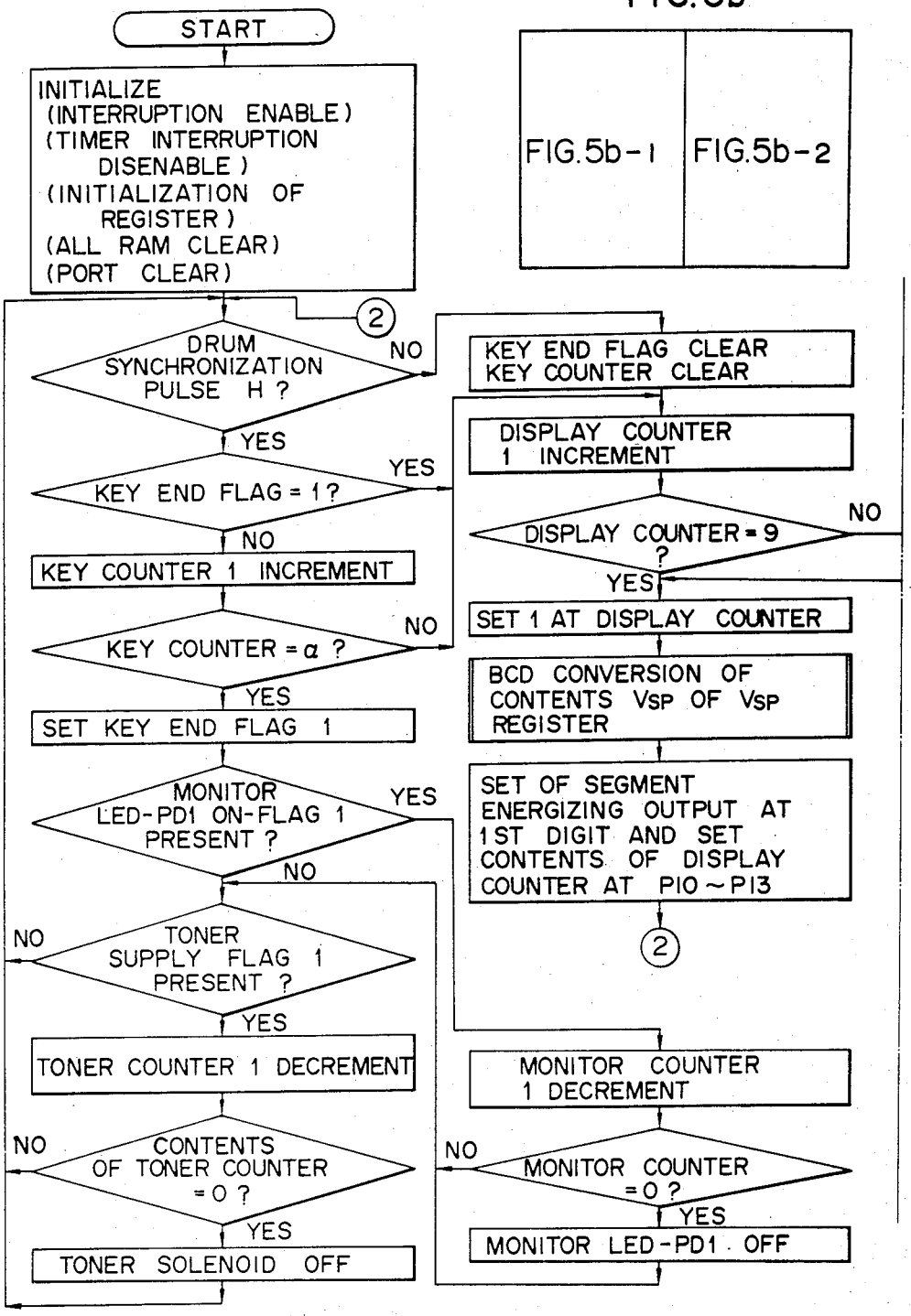
Figures 2, 5B:
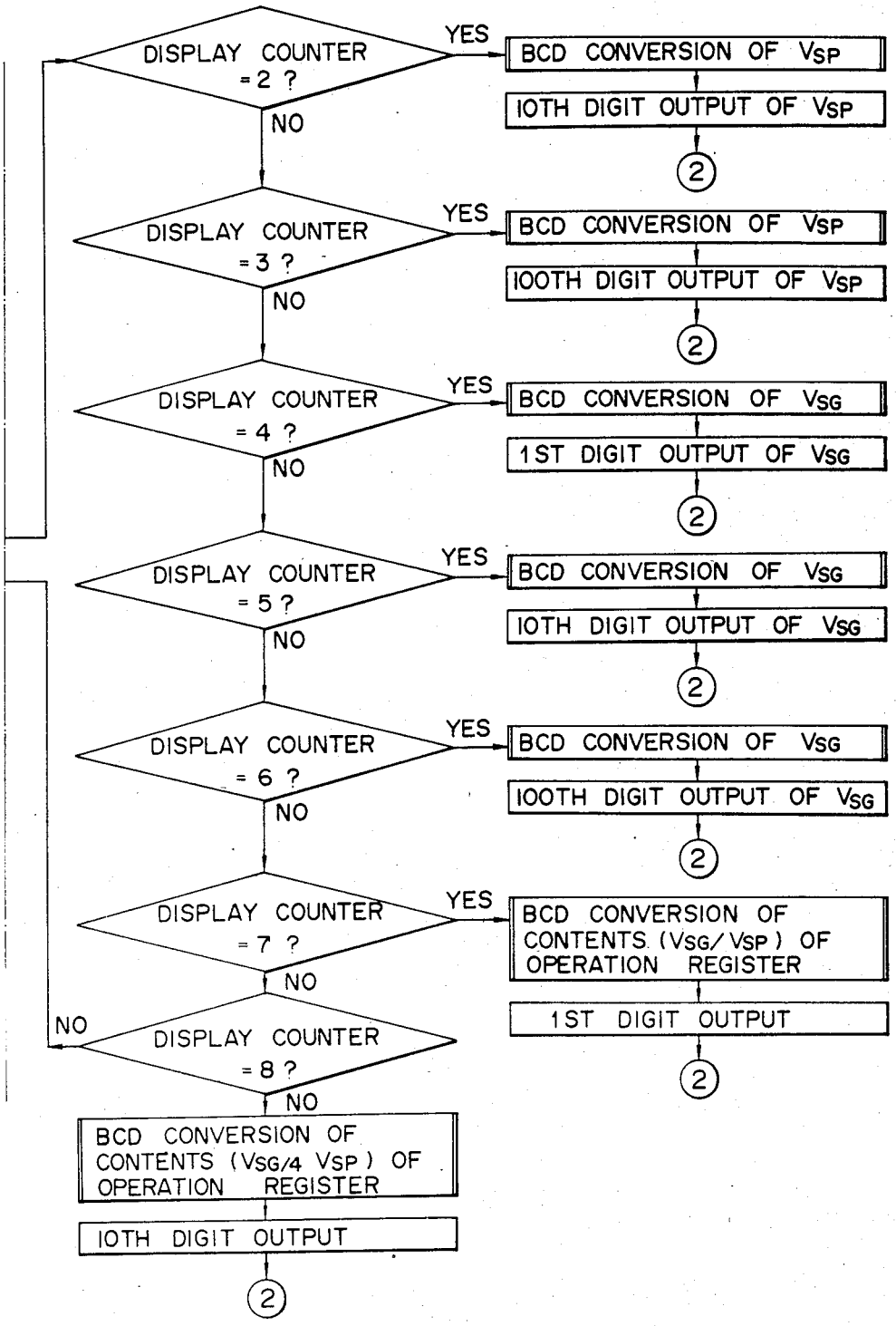

As mentioned previously by referring to FIGS. **5*a*-1 and 5*a*-2, when the toner concentration control command pulse is applied to the MPU2 from the MPU1, 16 is set at the monitor counter, so that the PD1 is turned on. Thereafter the step proceeds to the main routine as shown in FIGS. 5*b*-1 and 5*b*-2 after the steps of the image density detection through the setting of toner supply (toner counters 1 and 2). Furthermore, as shown in the main flow shown in FIGS. 5*b*-1 and 5*b*-2, the contents of the monitor counter are subjected to one decrement at the arrival of each drum rotation synchronization pulse. As a result, after completion of the interruption processing shown in FIGS. 5*a*-1 and 5*a*-2**, followed by the generation of 16 drum rotation synchronization pulses, the PD1 is turned off.

When the key end flag 1 is set, that is, when an index indicating the arrival of one pulse of the drum rotation synchronization pulse is set, the MPU2 performs one decrement of the toner counters (1, 2) when the toner supply flag indicates 1 by which it is indicated that the conduction setting of the solenoid 16 has been finished and when the contents of the toner counters (1, 2) become zero, the MPU2 deenergizes the solenoid 16. When the contents of the toner counters (1, 2) are not zero, the display energization control is performed while waiting for the drum synchronization pulse to become L. When the drum synchronization pulse becomes L, the key end flag and the key counter are cleared on the supposition that one drum rotation synchronization pulse has arrived, so that the MPU2 waits for the port To to become H, while energizing the displays. Thus, each time one drum rotation synchronization pulse arrives, the toner counters (1, 2) are subjected to one decrement, and when the contents of the toner counters (1, 2) become zero, that is, when toner supply time is set in the toner counters (1, 2) and the solenoid 16 is then turned on, and the just mentioned toner supply time has passed, the solenoid 16 is turned off. Thereafter, the MPU2 performs only the display energization control.

Figure 6:
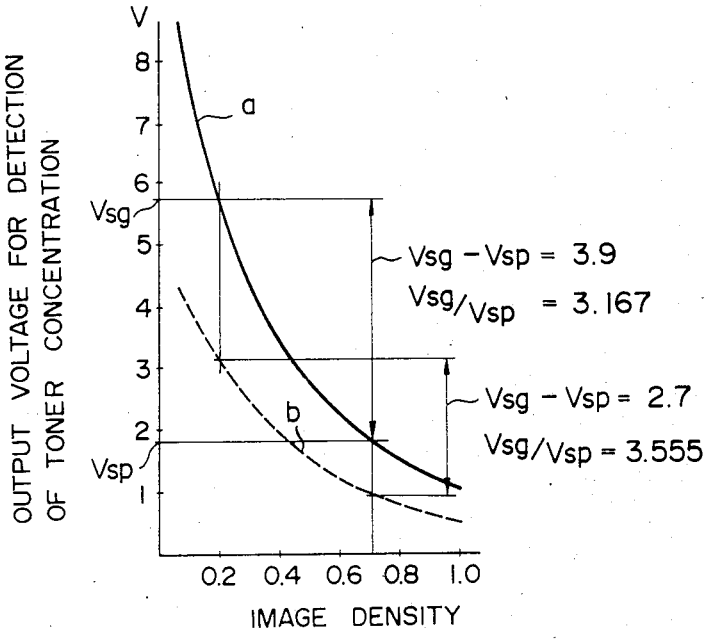
FIG. 6 is a graph showing the relationship between image density and output voltage corresponding to detected toner concentration in a photosensor for use in the present invention.

In the above described embodiment, since the amount of the toner to be supplied is determined by the ratio $V_{SG}/V_{SP}$ of the image density of the white pattern to that of the black pattern, comparatively stable toner concentration control can be attained against changes in the characteristics of the photosensor and changes in the characteristics of the photoconductor. For instance, referring to FIG. 6, there is shown by the solid line a the relationship between the image density and the output voltage for detecting image density, obtained by the photosensor 11 and, accordingly, for detecting toner concentration. When that relationship is shifted as shown by the broken line b due to changes in characteristics of the photosensor 11 and/or of the surface of the photoconductor, the difference between the image density detection voltage $V_{sg}$ of a white pattern and the image density detection voltage $V_{sp}$ of a black pattern changes from 3.9 V to 2.7 V, with a change of 31% $(=(3.9-2.7)/3.9\times 100\%)$. On the other hand, the ratio of $V_{sg}/V_{sp}$ changes from 3.167 to 3.555, with a change of 12.3% $(=(3.555-3.167)/3.167\times 100\%)$. This indicates that the ratio of $V_{sg}/V_{sp}$ is rather stable against changes in characteristics of the photosensor and/or of the photoconductor.

In the above example, the A/D conversion resolution for the black pattern toner image density detection voltage $V_{sp}$ is set so as to be 4 times the A/D conversion resolution for the white pattern toner image density detection voltage $V_{sg}$.

As known conventionally, the image density detection level of the developed toner images varies from place to place due to the presence of non-uniform developed portions or pin-hole-like non-image portions. The absolute value of the variation in image density detection level is greater in $V_{sg}$ than in $V_{sp}$. Therefore, if detection resolution is determined separately for each image pattern, and the input voltage level for the A/D conversion for each image pattern is made equal to each other, it does not occur that one detection level predominates over the other detection level.

Furthermore, in the case of the A/D conversion using the same resolution, the range which covers both $V_{SG}$ and $V_{SP}$ has to be expanded. In this case, unless the bit number of the A/D data increases, the weight of $V_{SP}$ becomes smaller than that of $V_{SG}$. However, the smaller the bit number of the A/D data, the better in terms of the construction of operation elements and operational processing. In other words, for instance, when $V_{SG}$ is 4 V and $V_{SP}$ is 0.4 V and those data are measured with a resolution of 0.1 V, the measured values of the two are respectively, $V_{SG}=4.0$ V and $V_{SP}=0.4$ V, with two significant digits and one significant digit, respectively. Therefore, the result of the comparison operation is obtained with one significant digit.

In the case where the comparison operation result with two significant digits is necessary, there will be the following two choices:

1st Method : Resolution of 0.01 V is used for measurement of both $V_{SG}$ and $V_{SP}$.

2nd Method : Resolution of 0.1 V is used for the measurement of $V_{SG}$, while resolution of 0.01 V is used for the measurement of $V_{SP}$.

In the case of the first method, when $V_{SG}$ is measured, the measurement result is obtained with 3 significant digits. When comparison operation is performed, either operation with 3 digits or operation with $V_{SG}$ converted to a 2-digit value has to be employed. In contrast to the 2nd Method, the 1st Method, requires increase of operation digits in number or additional operations.

As described previously, the preliminary experiments indicated that $V_{SG}$ and $V_{SP}$ are respectively set at 4 V and 1.6 V and $V_{SG}/V_{SP}=2.5$. Therefore, by measuring the $V_{SP}$ with a resolution of 1/2.5 or less of the resolution of the $V_{SP}$, the accuracy of the comparison operation is not reduced by measuring $V_{SP}$.

The A/D converter employed in the above embodiment has a range expansion function and measures $V_{SP}$ with $\frac{1}{4}$ of the resolution of the $V_{SG}$, without using external circuits.

As mentioned previously, by setting a resolution for each image pattern, the bit number of the A/D data can be reduced and, accordingly, the structure of the elements and the operation processing are simplified.

Other embodiments of a recording image density control method for electrophotography according to the present invention will now be explained.

In the above explained embodiment, the white charging patterns and black charging patterns are formed on the surface of the photoconductor by subjecting the corresponding optical marks $MR_G$ and $MR_P$ formed in an edge portion of the contact glass 1 to exposure scanning. Those white charging pattern and black charging pattern can be formed by charging-and-non-charging control of the charger 5, ON-OFF control of the exposure lamp or of the erasing lamp 6, or development bias voltage application control of the development roller 7.

Furthermore, in the above explained embodiment, the image densities of developed toner images of those white charging pattern and black charging pattern on the photoconductor are detected by the photosensor 11 in order to obtain relevant image density data. However, as the relevant image density data, the surface potentials at the white and black charging patterns which are not developed, the surface potentials at the developed toner images of those white charging pattern and black charging pattern, and the image densities of the toner images of those white charging pattern and black charging patterns transferred to a transferred sheet can be employed.

In the above explained embodiment, the amount of toner to be replenished is determined by the ratio of the above mentioned image densities of the developed toner images of the white pattern and black pattern, whereby the recording image density is controlled so as to be constant. However, such control of recording image density can be performed by the ratio(s) of two or more data selected from the relevant image density data, such as charging control data of the charger 5, exposure control data, development bias voltage application control data, toner replenishment control data to a developer, toner replenishment control data to a development apparatus, and image transfer charge application data.

In any case, since the variable ranges of those relevant image density data are inherently different between the two patterns and are variable due to the deterioration of members for detecting those data or changes in ambient temperature during detection of those data, in order to attain stable image density control, it is necessary that the relevant image density data of each pattern be subjected to A/D conversion, each with an appropriate resolution, and the ratio be calculated and the parameters for determining the image density be determined in accordance with the thus obtained ratio. By so doing, the present invention has attained the above described stable recording image density control.

What is claimed is:

1. A recording image density control method for electrophotography in which latent electrostatic images are formed on a photoconductor by charging the surface of said photoconductor, followed by exposing the charged surface of said photoconductor to optical images, said latent electrostatic images are developed to toner images by a developer supplied from a development apparatus, and said toner images are transferred to a transfer sheet under application of image transfer charges thereto, comprising the steps of:

forming at least two latent electrostatic image patterns with different electric potentials on the surface of said photoconductor;

developing said latent electrostatic images patterns to toner image patterns by use of toner contained in said developer;

detecting a value relating to the image density of each said developed toner image pattern, with a different resolution for each said developed toner image pattern, by (1) converting the image density to an image density detection voltage, (2) dividing said image density detecting voltage into at least two image density detecting voltages with predetermined ratios, a direct image density detection voltage and a divided image density detection voltage, (3) inputting said direct image density voltage to a first channel of an A/D converter and said divided image density voltage to a second channel of said A/D converter, (4) comparing said direct image density voltage with a reference voltage, and when said direct image density voltage is not greater than said reference voltage, and direct image density voltage is employed as said value relating to the detected image density, while when said direct image density is greater than said reference voltage, said divided image density voltage input to said second channel of said A/D converter is employed as said value relating to the detected image density;

determining the ratio said value for one image pattern to said value for the other image pattern; and controlling a recording image density controlling parameter in accordance with said ratio.

2. A recording image density control method for electrophotography as claimed in claim 1, wherein said two latent electrostatic image patterns form a white image pattern substantially free from toner images and a black image pattern with a solid toner image when developed.

3. A recording image density control method for electrophotography as claimed in claim 1, wherein said two latent electrostatic image patterns with different electric potentials are formed by projection of two image patterns with different image densities onto the surface of said photoconductor.

4. A recording image density control method for electrophotography as claimed in claim 1, wherein said recording image density controlling parameter is the concentration of toner in said developer.

5. A recording image density control method for electrophotography as claimed in claim 1, wherein said recording image density controlling parameter is the amount of toner supplied to said development apparatus.

* * * * *